United States Patent [19]

Dorr et al.

[11] 4,375,829

[45] Mar. 8, 1983

[54] FRAMING APPARATUS, METHOD AND FRAMING MEMBER

[75] Inventors: George G. Dorr, Fairport; James R. Miller, Hamlin, both of N.Y.

[73] Assignee: Giltspur Exhibits/Rochester, Rochester, N.Y.

[21] Appl. No.: 273,075

[22] Filed: Jun. 12, 1981

[51] Int. Cl.[3] ..... A47G 5/00

[52] U.S. Cl. ..... 160/135

[58] Field of Search ..... 160/135, 350, 351, 377, 160/381; 52/239, 489, 580, 589, 586, 709, 710, 729, 732, 581

[56] References Cited

U.S. PATENT DOCUMENTS

| | | | |
|---|---|---|---|
| 1,511,764 | 10/1924 | Jordahl | 52/710 |
| 3,273,633 | 9/1966 | Seidmon et al. | 160/381 |
| 3,349,528 | 10/1967 | Salt | 52/239 |
| 3,356,403 | 12/1967 | Sak et al. | 160/135 |
| 3,386,221 | 6/1968 | Giovannucci | 52/586 |
| 3,571,999 | 3/1971 | Downing | 160/351 |
| 3,768,222 | 10/1973 | Birum, Jr. | 160/135 |
| 4,068,428 | 1/1978 | Peterson | 160/354 |
| 4,068,700 | 1/1978 | Legler | 160/381 |
| 4,147,198 | 4/1979 | Ytter | 160/381 |
| 4,232,183 | 11/1980 | Person | 160/135 |

*Primary Examiner*—Peter M. Caun

*Attorney, Agent, or Firm*—Schovee, Boston & Greenwald

[57] ABSTRACT

A framing system including a framing apparatus (10) comprising a series of self supporting frames (12, 14, 16 and 18) held together by joiner strips (28 and 30) and supporting decorative panels (20, 22, 24 and 26); the apparatus (10) can be used as walls, partitions, or for displays at exhibits and trade shows. The framing apparatus can be easily and quickly set up without tools, and the panels are easily removable and replaceable even after the system is set up. The frames can include electrical outlets (36) and cross strips (150) with a slot (154) for supporting heavy articles to be hung on the frames. A framing method and framing member are also enclosed.

9 Claims, 11 Drawing Figures

FIG. 1
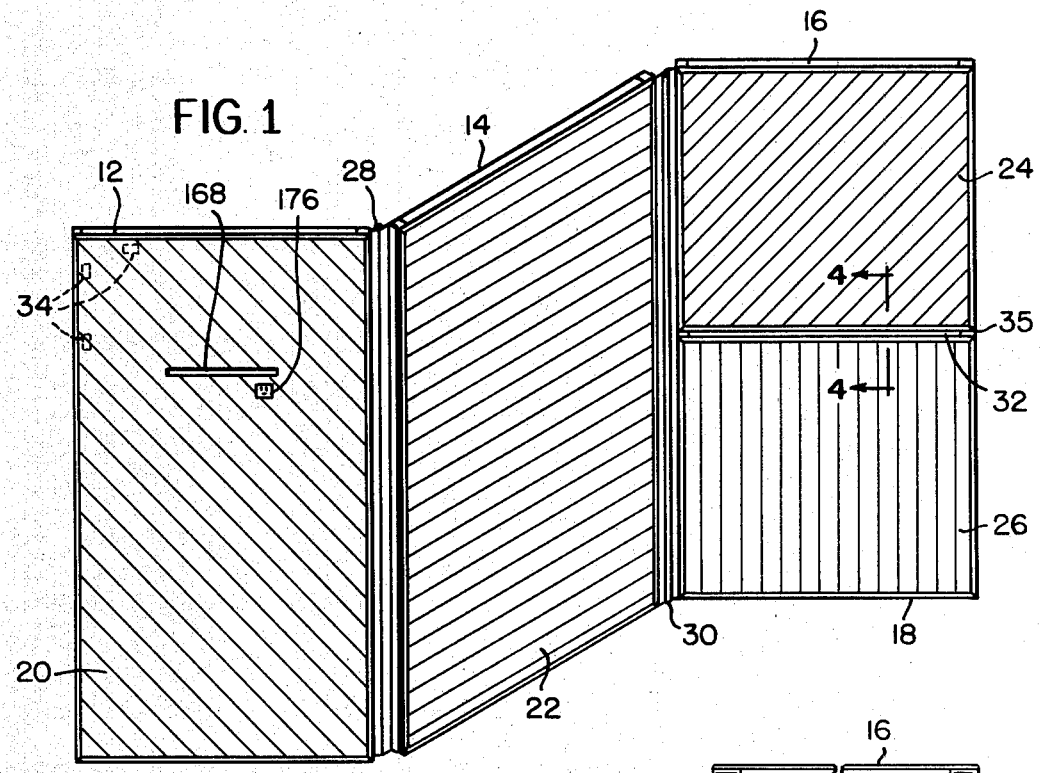
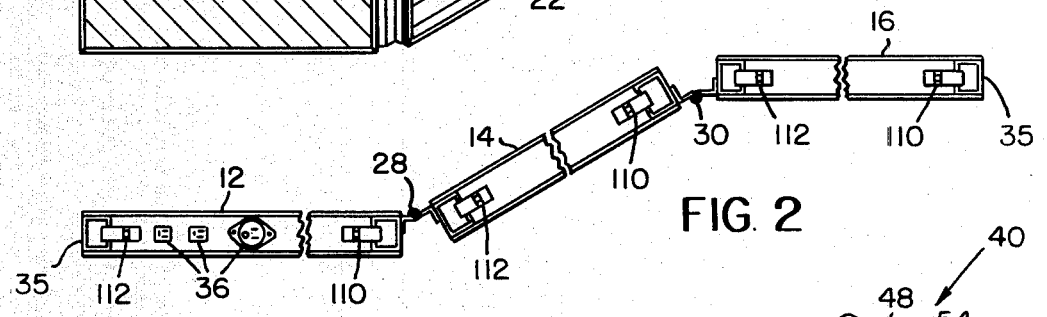
FIG. 2
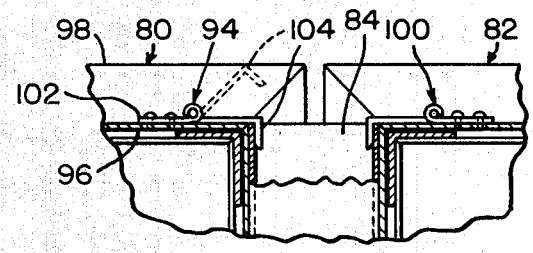
FIG. 6
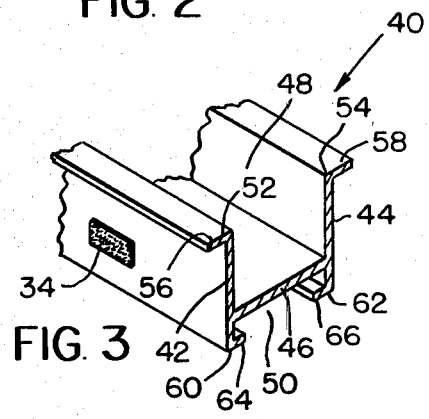
FIG. 3
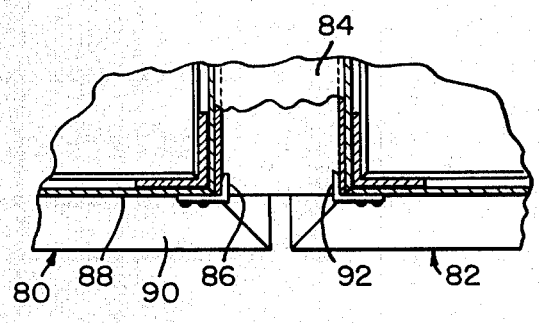
FIG. 5
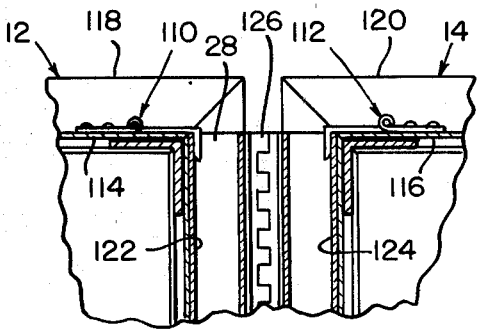
FIG. 7

FRAMING APPARATUS, METHOD AND FRAMING MEMBER

TECHNICAL FIELD

A framing system for supporting panels for use as walls, partitions, office landscaping, displays such as at shows, seminars, meetings, exhibits, trade shows and the like, and in particular to a framing system which is compact for storage and delivery but which is easily set up without tools.

BACKGROUND

In the past, panels for trade shows were either one large piece, which was cumbersome to store and deliver, or were made up of fold-up units using complicated arrangements of cables and hinges for set-up, or which used modular units requiring different types of pin connectors and which had to be disassembled to change panels.

There are also a very large number of different framing systems known using framing members of various cross-sectional shapes and various types of corner brackets. .The following U.S. patents show known framing systems: Des. 253,552, U.S. Pat. Nos. 3,783,543, 4,195,681, 2,201,577, 2,666,508, 2,784,813, 2,447,347, 3,648,393, 3,709,533, 3,124,858, 2,504,700 and 2,923,351.

It is an object of the present invention to provide a framing system that can be delivered in a small size and can be easily set up without tools.

It is another object to provide a framing system wherein the edges of the supported panels do not have to be finished because they are hidden by and protected by a finished framing member.

It is a further object to provide a framing system using a framing member of different lengths but of identical cross-sectional shape and using joiner strips of different lengths but of identical cross-sectional shape and which can provide a very large variety of different framing arrangements by simply varying the lengths of the framing members and of the joiner strips.

It is another object to provide a framing system in which the panels can be easily hingedly connected together to vary their angular relationship.

It is a further object to provide a framing system in which a wide variety of different types of panels can be connected to the frames, on one or both sides, and in a variety of different ways and which panels can be removed and replaced after the frame system has been set up, without having to disassemble it in any way.

It is another object to provide a framing system in which an electrical cord can be included in the frame members and electrical outlets can be provided on the frame members where desired.

BRIEF SUMMARY OF THE INVENTION

A framing system including a framing apparatus, method and framing member. The framing member is substantially H-shaped in cross-section providing an inner U-shaped channel (facing or opening radially inwardly of the frame toward the supported panel) and an outer U-shaped channel facing or opening radially outwardly away from the frame.

The framing apparatus includes specific frames and also includes a group of frames assembled together by a joiner strip. For frames arranged vertically one above the above, a horizontally oriented joiner strip is simply placed, part in each of the adjacent, facing outer channels. For frames arranged horizontally side-by-side a vertically oriented joiner strip is also placed, part in each of the adjacent, facing outer channels, however, in addition, in order to hold the two frames together, the joiner strip is held to each frame by an upper hinged connector and a lower clip, each of which fits into the upper and lower hollow ends, respectively, of the joiner strip. The joiner strip is preferably a tubular member of rectangular cross-section. In one embodiment, the joiner strip is made of two separate, smaller joiner strips hinged together, whereby the adjacent connected frames (and their panels) can be positioned at an angle to each other on the floor, which not only helps stabilize the frames but also provides more display area in a given space.

The method includes the method of easily setting up the framing apparatus without tools.

BRIEF DESCRIPTION OF THE DRAWINGS

The present invention will be more fully understood by reference to the following detailed description thereof, when read in conjunction with the attached drawings, wherein like reference numerals refer to like elements and wherein:

FIG. 1 is a front, perspective view of a set-up framing system according to the present invention;

FIG. 2 is a top view of the system shown in FIG. 1;

FIG. 3 is a cross-sectional, perspective view through the framing member according to the present invention;

FIG. 5 is a partial cross-sectional view showing two frames connected to the bottom of a joiner strip;

FIG. 6 is a partial cross-sectional view showing two frames connected to the top of a joiner strip;

FIG. 7 is a partial cross-sectional view showing two frames connected to the top of a hinged joiner strip;

DETAILED DESCRIPTION OF THE INVENTION

Figure 10:
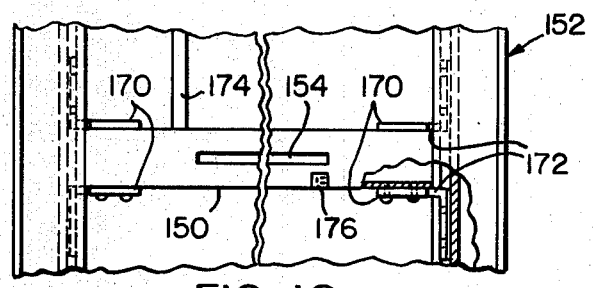
FIG. 10 is a front, partial cross-sectional view showing one embodiment of the present invention of a cross-strip added to the frame.

With reference now to the drawings, FIGS. 1 and 2 show a framing apparatus 10 set up and free standing and including two full size frames 12 and 14, two half size frames 16 and 18, a different removable panel 20, 22, 24 and 26 on each of the frames 12, 14, 16 and 18, respectively, a pair of vertical hinged joiner strips 28 and 30, and a horizontal joiner strip 32. The framing apparatus 10 can be easily and quickly set from the individual pieces and without tools. The opposite sides of the frames 12, 14, 16 and 18 can also be provided with panels if those sides are also to be in view. The frames can be of any desired size, however, in one preferred embodiment frame 12 is about seven feet high, four feet wide and 2¾ inches thick. Any desired number and arrangement and size of frames can be used. FIGS. 1 and 2 also show a finishing strip 35, which will be described in more detail below.

The panels can be attached to the frames by any suitable means (as described in more detail below), but preferably by a series of spaced-apart Velcro or other self-adhering strips 34, only three of which are shown in FIG. 1. In this way, the panels can be easily removed and replaced with different panels. The panels can be made of any desired material, such as glass, plexiglas, press-board, wood, etc., however, the presently preferred material is plywood covered with another material such as cloth, carpet, or a Formica laminate. The paneled frames can be used as walls or partitions, or they can be used in exhibits with display material hung therefrom or with the panel being the display. The panels can be transparent or translucent and can be front or rear lighted.

FIG. 2 is a top view of the framing apparatus 10 of FIG. 1 showing the frames 12, 14, 16 and the hinged joiner strips 28 and 30. FIG. 2 also shows three electrical outlets 36, two female and one male, in the top of frame 12. The joiner strips 28 and 30 will be described in more detail below.

FIG. 3 shows the cross-sectional shape of a framing member 40 according to the present invention. Each of the frames 12, 14, 16 and 18 are made of four framing members identical in cross-section to framing member 40. The framing member 40 is substantially H-shaped in cross-section with two parallel legs 42 and 44 connected by a transverse web 46, forming an outer U-shaped channel 48 and an inner U-shaped channel 50. The outer channel 48 is deeper than the inner channel 50 and faces or opens outwardly away from the frame (such as frame 12) and the inner channel 50 faces or opens inwardly into the inside of the frame (such as frame 12).

The outer edges 52 and 54 of the legs 42 and 44, respectively, (the edges adjacent the outer channel 48) include outwardly extending flanges 56 and 58. The flanges 56 and 58 provide protection for the edges of the panels (such as panel 20 in FIG. 1); the panel edges are covered or hidden by these flanges so that such edges need not be finished, and the flanges provide a neat, straight, appearance for the edge of the paneled frames.

The inner edges 60 and 62 of the legs 42 and 44, respectively, (the edges adjacent the inner channel 50) include inwardly extending flanges 64 and 66. The purpose for the flanges 64 and 66 will be described below with respect to FIGS. 8 and 9.

The ends of each of the four framing members used to form each frame (such as frame 12) are mitered and are connected by angle brackets as will be described below with reference to FIGS. 8 and 9. FIG. 3 also shows a Velcro strip 34 adhesively attached to the framing member 40.

Figure 4:
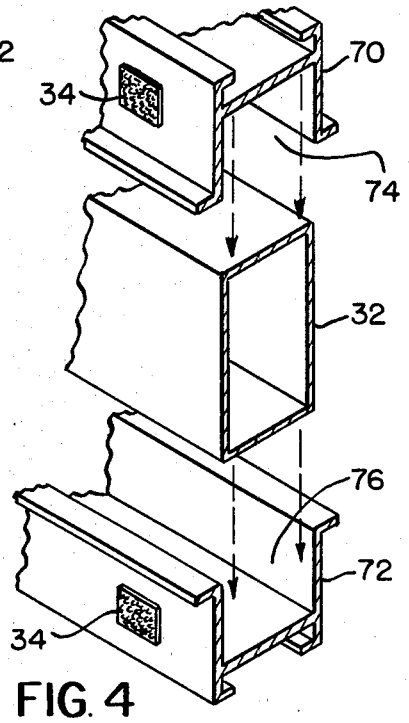
FIG. 4 is a partial cross-sectional, perspective, exploded view, taken along line 4—4 in FIG. 1, showing two frames assembled together by a horizontal joiner strip.

FIG. 4 is a cross-sectional, exploded, view through the assembled portion of frames 16 and 18 of FIG. 1. FIG. 4 shows a bottom frame member 70 of the frame 16, a top frame member 72 of the frame 18, and the horizontal joiner strip 32. The joiner strip 32 is preferably a tube of rectangular cross-section that forms a slip-fit into the open channels 74 and 76, respectively, of the frame members 70 and 72. Preferably, the width of the joiner strip 32 is greater than twice the depth of the open channels 74 and 76, so as to space the frames 16 and 18 apart a small distance, such as about $\frac{1}{4}$ to $\frac{1}{2}$ inch. Alternatively, the frames 16 and 18 can be allowed to be in abutting contact with each other. The joiner strips do not have to be attached or connected to either frame, since the slip fit is sufficient to maintain the frames 16 and 18 in proper vertical alignment and with sufficient stability.

While FIG. 4 shows how vertically adjacent frames in a framing apparatus are assembled, FIGS. 5 and 6 show how horizontally adjacent frames 80 and 82 are connected by means of a vertical joiner strip 84. FIG. 5 shows a clip 86 screwed to a web 88 of a bottom frame member 90 of the frame 80. A clip 92 is similarly attached to the frame 82. FIG. 6 shows a hinged connector 94 screwed to a web 96 of a top frame member 98 of the frame 80, and another hinged connector 100 is similarly connected to the frame 82. The hinged connector 94 includes a fixed member 102 and a movable finger 104 hingedly connected to the fixed member. The bottom end of the joiner strip 84 is placed on the clips 86 and 92 with the movable fingers of the hinged connected raised (to the position shown in dotted lines in FIG. 6). The fingers are then lowered over the top end of the joiner strip 84, thus securely holding the frames 80 and 82 together.

FIG. 7 is an enlarged cross-sectional view showing how the two frames 12 and 14 of FIG. 1 are connected at their tops to the hinged joiner strip 28. FIG. 7 shows a pair of hinged connectors 110 and 112 (each identical to the hinged connectors 94 and 100 of FIG. 6) connected to webs 114 and 116, respectively, of the top frame member 118 and 120, respectively, of the frames 12 and 14. As shown in FIG. 7, the hinged joiner strip comprises a pair of identical, separate, tubular members 122 and 124 connected by a hinge 126. The bottom end of the joiner strip 28 is held in clips (not shown) identical to those shown in FIG. 5.

By simply reversing the hinged joiner strip 28, the two frames 12 and 14 can be made to move at an angle to each in the opposite direction from that shown in FIG. 1. It is to be noted that can be easily and quickly done without the use of tools.

Figure 8:
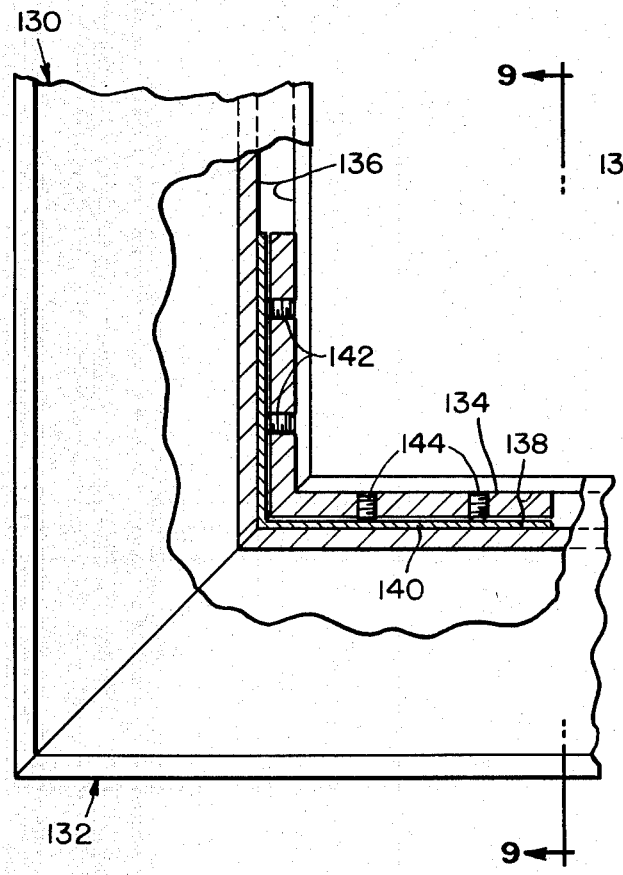
FIG. 8 is an enlarged partial cross-sectional front view of one corner of a frame.
Figure 9:
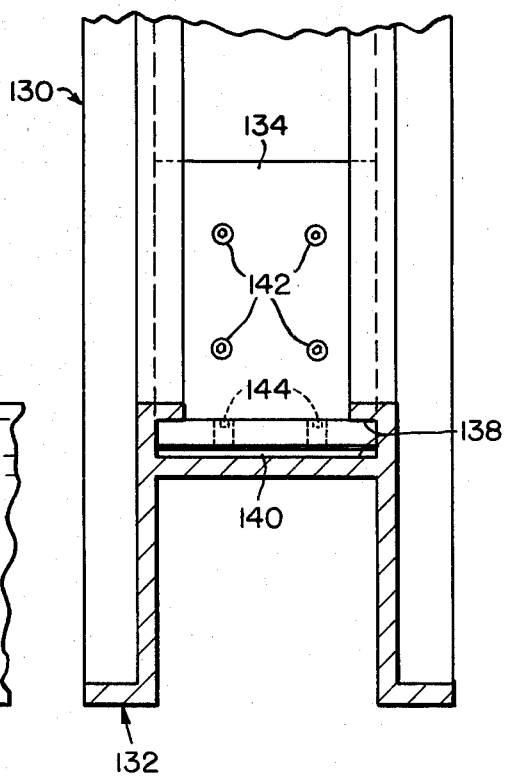
FIG. 9 is an enlarged cross-sectional end view of one corner of a frame, taken along line 9—9 of FIG. 8.

FIGS. 8 and 9 show how the ends of two adjacent framing members (such as left side member 130 and bottom frame member 132 of frame 12 of FIG. 1) are connected to form a frame corner. All of the four corners of each frame are identically constructed and thus only one need be shown. The ends of the frame members 130 and 132 are mitered to form a mitered joint or corner. An L-shaped angle bracket 134 is inserted with one leg in each of the inner channels 136 and 138 of the frame members 130 and 132, respectively. An L-shaped spacer element 140 is also preferably positioned in the channels along with the angle bracket 134 and toward the outside of the frame from the angle bracket. The angle bracket is provided with two internally screw threaded holes 142 in each leg, and a set screw 144 is then screwed down against the spacer element forcing the spacer element and the angle bracket apart thus wedging them tightly in place in the inner channels and thus tightly forming the mitered corner. The set screws have polygonal openings for receiving a mating Allen wrench. The spacer elements help to spread the force of the set screw, however, they can be omitted if desired.

Figure 11:
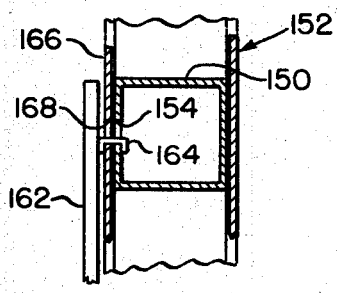
FIG. 11 is a partial cross-sectional side view showing how an item connects to the cross-strip of FIG. 10.

FIGS. 10 and 11 show another embodiment of the present invention wherein a cross strip 150 is added to a frame 152. The cross strip can be located anywhere desired in the frame. The cross strip 150 includes a slot 154 in the front side thereof. This provides another way of hanging items to the frame 152, and in particular, heavy items. FIG. 11 shows a heavy article 162 having a rear bracket 164 that fits into and hangs from the slot 154. The frame 152 can have a panel 166 thereon with a corresponding slot 168 through which the bracket 164 extends. While only one slot 154 is shown, it is preferred that the cross strip 150 have such a slot 154 in each of its outwardly facing sides (and a corresponding slot in each panel).

The cross strip 150 is preferably supported by brackets 170 identical to brackets 134 except for a cut out or notch 172 on each side of one leg (the horizontal leg) to accommodate the flanges 64 and 66 (see FIG. 3). The vertical leg of the brackets 170 are attached using set screws as with the angle bracket 134 of FIG. 8. An L-shaped spacer element is not used here, however, a straight spacer element can be used under the vertical leg of the bracket 170. The horizontal leg of the lower bracket is screwed, by machine screws, directly to the cross strip 150. The horizontal leg of the upper bracket 170 need have no screw connection to the cross strip.

An electrical conduit 174 provides electrical conductors from the frame members into the cross strip to allow an electrical outlet 176.

For those open channels of a frame (such as the left edge of frame 12 in FIG. 1) which form an end of a frame apparatus and thus do not have need for a joiner strip therein, a finishing strip 35 (see FIG. 1) is preferably placed therein to form a smooth finished end surface. The finishing strip 35 has a depth equal to that of the outer channel and is held in place in the same manner as are the vertical joiner strips 28 and 30. Finishing strips need not be placed in the outer channel on the top of the frame, and in fact, this open channel can be suitably used to hold brackets for supporting lighting fixtures and the like.

In a preferred embodiment of the present invention, the framing member 40 is made of extruded aluminum. The flanges 56 and 58 each have a width of about ½ inch. The flanges 64 and 66 each have a width of about 0.375 inch. The channels 48 and 50 have a width of about a 1¾ inch. The height of the member 40 is about 1.9 inch. The thickness of the walls are about 0.125 inch. The depth of the outer channel 48 is about 1.25 inches. The depth of the inner channel 46 is about 0.28 inch. The ends of the framing members 40 are mitered at 45°. The angle bracket 134 is prepared from a 4 inch by 2 inch by 3/16 inch aluminum strip. Each leg of the L-shaped bracket is 2 inches by 2 inches.

While the presently preferred embodiment uses an extruded aluminum frame member 40, other materials can be used including plastic, which would be less expensive and lighter weight. Also, the frame member does not have to be of one-piece construction but can be made of separate parts joined together by welding, screws, etc.

The flanges 56 and 58 can be omitted, if desired, although then the panels edges themselves should preferably be finished. The flanges 64 and 66 can be omitted, with a different angle bracket connection being made, such as by simply screwing the angle brackets 134 directly to the web 46.

The panels (such as 20 in FIG. 1) can be connected to the frame 12 in any desired way, the preferred being a series of spaced-apart Velcro strips attached to the frame and also attached at mating locations on the back of the panel.

If a series of frames is to be placed in a long line, then transverse leg extensions can be attached to the bottom of the frames for better support. Also, and alternatively, the vertical joiner strips, such as 84 in FIGS. 5 and 6, can extend above the top of the frames for attachment to the ceiling, for example, or for attaching lights or other fixtures thereto.

The horizontal joiner tube 32 in FIG. 4 is simply a means for assemblying two frames together (holding them in their desired location and orientation) that are located one on top of the other. No connection means are required. However, for frames that are side by side, they should be physically connected (held together) as by the connecting means including, in FIGS. 5 and 6, for example, the vertical joiner strip 84, the clips 86 and 92 and the hinged connectors 94 and 100.

The joiner strips are preferably tubular and slip fit in the outer channels, however, they can have other constructions and shapes, if desired, and other means for connecting them to the frames can be used. Other ways of providing a hinged joiner strip can also be used, as will be understood by one skilled in the art. The inner and outer channels and the joiner strips can have other than rectangular cross-sections. The frames preferably use four framing members and are preferably mitered at 45°; however, other numbers of framing members and other angles of miter can be used. The actual depths and the relative depths of the channels can be varied from the preferred ones described above, as desired.

If the floor on which the frames are to rest is not level, leveler legs can be attached to the bottom of the frames.

For use of the framing system of this invention in office landscaping, it may be desirable to make the framing member 40 larger and heavier.

The invention has been described in detail with particular reference to the preferred embodiments thereof, but it will be understood that variations and modifications can be affected within the spirit and scope of the invention as described hereinafter and as defined in the appended claims.

I claim:

1. A framing system comprising:

(a) two frames, each frame comprising four elongated framing members;

(b) each of said framing members being of identical, substantially H-shaped cross-section and having mitered ends, and said framing members being connected together at their mitered ends to form mitered frame corners, the cross-sectional shape of said framing members comprising two substantially parallel, spaced-apart legs joined by a transverse web substantially perpendicular to said legs, thereby forming inner and outer U-shaped channels on opposite sides of said web, said framing members being connected such that said inner channel opens inwardly into said frame and said outer channel opens outwardly away from said frame;

(c) said frames being located adjacent to each other with a first framing member of a first frame adjacent to a second framing member of a second frame, with the outer channel of said first framing member facing the outer channel of said second framing member;

(d) means for assembling said first and second frames together comprising a joiner strip having a first portion thereof positioned in said outer channel of said first framing member and a second portion thereof positioned in said outer channel of said second framing member;

(e) said first and second frames being located horizontally side by side, and (f) releasable connecting means connected to each of said first and second frames for releasably connecting said joiner strip thereto, and wherein said releasable connecting means comprises a clip for receiving and holding a bottom end of said joiner strip and a hinged connector for holding a top end of said joiner strip.

2. The apparatus as recited in claim 1 wherein said two frames are of identical height and wherein said joiner strip has a length approximately equal to the height of each of said two frames.

3. The apparatus as recited in claim 2 wherein said joiner strip is elongated and tubular and has a rectangular cross section.

4. The apparatus as recited in claim 3 wherein said joiner strip has a size such that it slip fits into said outer channels.

5. The apparatus as recited in claim 4 including a panel connected to at least one of said frames.

6. A framing system comprising:

(a) two frames, each frame comprising four elongated framing members;

(b) each of said framing members being of identical, substantially H-shaped cross-section and having mitered ends, and said framing members being connected together at their mitered ends to form mitered frame corners, the cross-sectional shape of said framing members comprising two substantially parallel, spaced-apart legs joined by a transverse web substantially perpendicular to said legs, thereby forming inner and outer U-shaped channels on opposite sides of said web, said framing members being connected such that said inner channel opens inwardly into said frame and said outer channel opens outwardly away from said frame;

(c) said frames being located adjacent to each other with a first framing member of a first frame adjacent to a second framing member of a second frame, with the outer channel of said first framing member facing the outer channel of said second framing member;

(d) means for assembling said first and second frames together comprising a joiner strip having a first portion thereof positioned in said outer channel of said first framing member and a second portion thereof positioned in said outer channel of said second framing member, and (e) said framing members being connected together at their mitered ends by an L-shaped angle bracket comprising a pair of legs, one each of said legs being positioned in the inner channel of adjacent ends of said frame members, and being connected to the web of said adjacent ends of said frame members, and wherein each of said framing members includes an inwardly extending flange on the edge of each of the legs of said framing members adjacent to said inner channel, and including set screws extending through internally screw threaded holes in each of said legs of said angle bracket for wedging said angle bracket legs between a respective web and pair of flanges.

7. An article comprising:

(a) a frame comprising four elongated framing members each having mitered ends and being connected at their mitered ends to form four mitered frame corners;

(b) each of said framing members being of identical, substantially H-shaped cross-section, the cross-sectional shape of said framing members comprising two substantially parallel, spaced-apart legs joined by a transverse web substantially perpendicular to said legs, thereby forming inner and outer U-shaped channels on opposite sides of said web, said framing members being connected such that said inner channel opens inwardly into said frame and said outer channel opens outwardly away from said frame;

(c) each of said framing members being connected together at their mitered ends by an L-shaped angle bracket comprising a pair of legs, one each of said legs being positioned in the inner channel of adjacent ends of said frame members, and being connected to the web of said adjacent ends of said frame members including an inwardly extending flange on the edge of each of the legs of said framing members adjacent to said inner channel, and including set screws extending through internally screw threaded holes in each of said legs of said angle bracket for wedging said angle bracket legs between a respective web and pair of flanges; and (d) each of said framing members including an outwardly extending flange on the edge of each of the legs thereof adjacent to said outer channel, whereby said outwardly extending flange is adapted to protect and hide the edges of any panels attached to said frame.

8. The apparatus as recited in claim 7 including a panel removably attached to said frame and having edges adjacent to said outwardly extending flanges.

9. The apparatus as recited in claim 7 including a cross strip connected between opposed vertical frame members and having a horizontal slot in an outer surface thereof for supporting an article.

* * * * *